United States Patent [19]

Trulaske

[11] 4,127,968

[45] Dec. 5, 1978

[54] DEBRIS-COLLECTING ASSEMBLY FOR SLIDING DOOR TRACK

[75] Inventor: James A. Trulaske, St. Louis, Mo.

[73] Assignee: True Manufacturing Co., Inc., O'Fallon, Mo.

[21] Appl. No.: 900,436

[22] Filed: Apr. 27, 1978

[51] Int. Cl.[2] ..... E05D 15/06

[52] U.S. Cl. ..... 49/404; 16/96 R; 16/100; 49/411

[58] Field of Search ..... 49/404, 425, 410, 411, 49/408; 16/100, 101, 96 R

[56] References Cited

U.S. PATENT DOCUMENTS

| | | | |
|---|---|---|---|
| 3,199,156 | 8/1965 | Riegelman | 49/408 |
| 3,418,755 | 12/1968 | Chiaro | 49/404 X |

*Primary Examiner*—Philip C. Kannan
*Attorney, Agent, or Firm*—Cohn, Powell & Hind

[57] ABSTRACT

A debris-collecting assembly for a sliding door track in which a door is slidably mounted in an elongate lower channel of a door frame for movement between open and closed positions, and a top-open pan is removably located in the channel, the pan being open at one end to receive debris swept along the channel when the door is in its open position, and to receive the door in its closed position. An elongate track is in the channel and slidably engages the door, the track being spaced from a closed channel end to provide a compartment, and the pan is removably located in the channel compartment with the open pan end facing toward the track. In a double door assembly a pair of channels are disposed in side-by-side relation with a door slidably mounted in each channel. A passage between the channels places the channels in communication. The pan is located in one channel with the open pan end disposed to receive debris swept along said other channel and through said passage when the door in said one channel is in the open position and the door in the said other channel is in the closed position.

11 Claims, 3 Drawing Figures

DEBRIS-COLLECTING ASSEMBLY FOR SLIDING DOOR TRACK

BACKGROUND OF THE INVENTION

This invention relates generally to improvements in a debris-collecting assembly for a sliding door track, and more particularly, to an improved assembly for cleaning the lower door channel without interferring with the usage of the door.

In the heretofore conventional devices such as beverage coolers using sliding doors, it was difficult to clean the lower door channels because the debris collected in such channels and there was no provision for easily removing it.

SUMMARY OF THE INVENTION

The present debris-collecting assembly provides for the location of a removable pan in the lower door channel adapted to receive and hold debris that collects in the channel, the pan being readily removed for emptying and being readily replaced. Moreover, the pan can be maintained at all times in the door channel without interferring with the operation of the sliding door.

In the present debris-collecting assembly, a door is slidably mounted in an elongate lower channel of a door frame for movement between open and closed positions, and a top-open pan is removably located in the channel, the pan being open at one end to receive debris swept along the channel when the door is in its open position, and to receive the door in its closed position.

More particularly, the channel has a bottom wall, opposed side walls, and a closed end wall, the channel being open at the top. The pan includes a bottom wall adjacent the channel bottom wall, side walls adjacent the channel side walls, and and end wall adjacent the channel end wall, the pan being open at the top and at the opposite end, and the pan being removable and replaceable through the open channel top.

An elongate track means is located in the channel and slidably engages the door, the track means being spaced from the closed channel end to provide a compartment therebetween. The pan is removably located in the channel compartment with the open pan end facing toward the track means.

In a double, sliding door assembly, the door frame includes a pair of elongate lower channels disposed in side-by-side relation, and a pair of doors, one door being slidably mounted in each channel for movement between open and closed positions. Passage means are provided between the channels, placing the channels in communication. The top-open pan is removably located in one channel with the open pan end being disposed to receive debris swept along said one channel and to receive debris swept along said other channel and through said passage means when the door in said one channel is in the open position and the door in the said other channel is in the closed position.

More particularly, in the present debris-collecting assembly, a partition is provided between the channels, and the passage means is provided in the partition adjacent the open pan end. One side wall of the pan is provided with an opening at the open pan end, the side opening being substantially aligned with the passage means in the partition.

In a double, sliding door assembly, an elongate track means is disposed in each channel and slidably engages and mounts the door in the channel, the track means being spaced from the closed channel ends to provide compartments therebetween. The pan is removably located in the compartment of one channel with the open pan end facing toward the track means in the said one channel. The passage means in the partition is located between the compartments.

BRIEF DESCRIPTION OF THE DEVICE

DESCRIPTION OF THE PREFERRED EMBODIMENT

Figure 1:
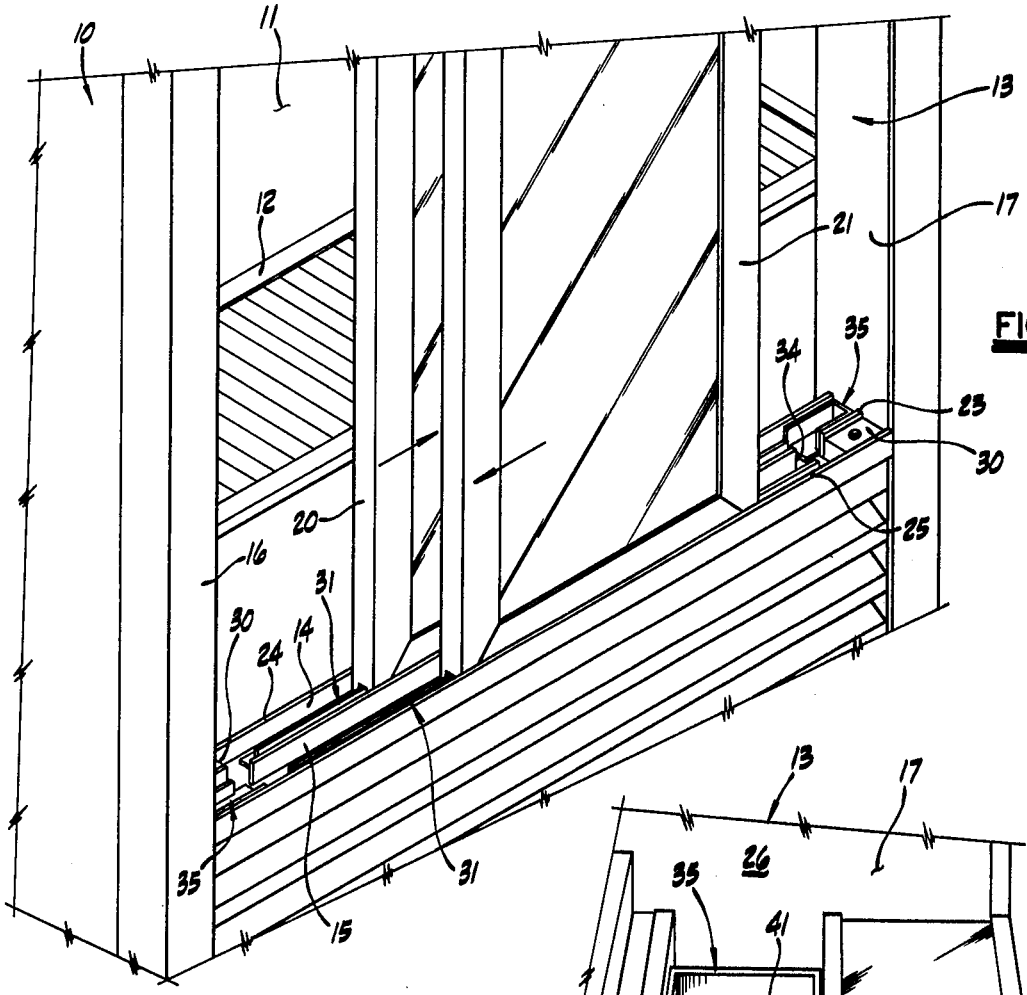
FIG. 1 is a fragmentary, perspective view of a beverage cooler having a double, sliding door, showing the debris-collecting assembly.
Figure 3:
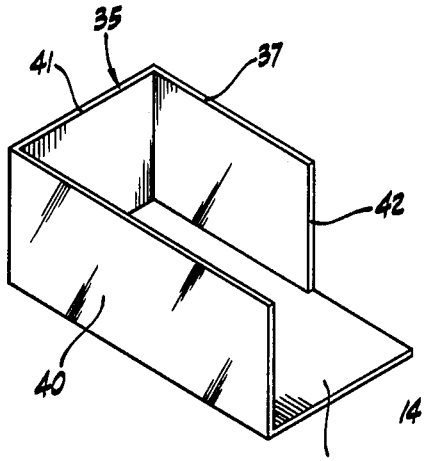
FIG. 3 is a perspective view of the removable pan.

Referring now by characters of reference to the drawing, and first to FIG. 1, the double, sliding door assembly is shown in a refrigerated beverage cooler indicated by 10 having a storage compartment 11 divided as by shelving 12. The front door frame referred to by 13 includes a pair of elongate lower channels 14 and 15 disposed horizontally in side-by-side relation, the channels 14 and 15 extending between side door jambs 16 and 17.

A pair of doors 20 and 21 are slidably mounted in the door frame 13, one door 20 being slidably mounted in channel 14 and the other door 21 being slidably mounted in channel 15.

Each channel 14 and 15 includes a bottom wall 22 with an intervening partition 23, constituting a side wall for each of the channels 14 and 15. Channel 14 includes an inner side wall 24, while channel 15 includes an outer side wall 25. The channel 14 is provided with a closed end 26 formed by the side door jamb 17. The channel 15 is provided with a closed end 27 formed by a block 30 fixed in the channel 15 adjacent the side door jamb 17.

Located in and extending along each of the channels 14 and 15, is a track means indicated by 31, the track means 31 including a base plate 32 fixed to the bottom wall 22 of the channel and an upstanding rail 33 that slidably mounts the associated door 20 or 21.

The track means 31 in channel 14 is spaced from the closed end 26 to provide a compartment in the channel 14 therebetween. The track means 31 in the channel 15 is spaced from the closed end 27 to provide another compartment in the channel 15 therebetween. For reasons which will later appear, the partition 23 is provided with a passage 34 placing the end compartments in the channels 14 and 15 in communication. Preferably, the passage 34 extends down to the bottom wall 22 of the channels 14–15.

A top-open pan 35 is removably located in channel 14, the pan 35 being open at one end to receive debris swept along channel 14 and to receive debris swept along channel 15 and through passage 34 when the door 20 in channel 14 is in the open position and the door 21 in channel 15 is in the closed position.

The pan 35 includes a bottom wall 36 seating on the bottom wall 22 of channel 14, side walls 37 and 40 disposed adjacent the partition 23 and channel side wall 24 respectively, and an end wall 41 disposed adjacent the closed end wall 26 of channel 14. The pan 35 is open at the top and at the end opposite to end wall 41. The pan 35 is removable and replaceable through the open top of channel 14.

When the pan 35 is removably located in the end compartment of channel 14, the open pan end faces toward the track means 31 in channel 14, the track means 31 terminating short of the open pan end.

The side wall 37 of pan 35 is provided with an opening 42 at the open pan end, the opening 42 being substantially aligned with the passage 34 in partition 23 so that debris can be easily passed from channel 15, through passage 34 and into the pan 35 for collection.

Figure 2:
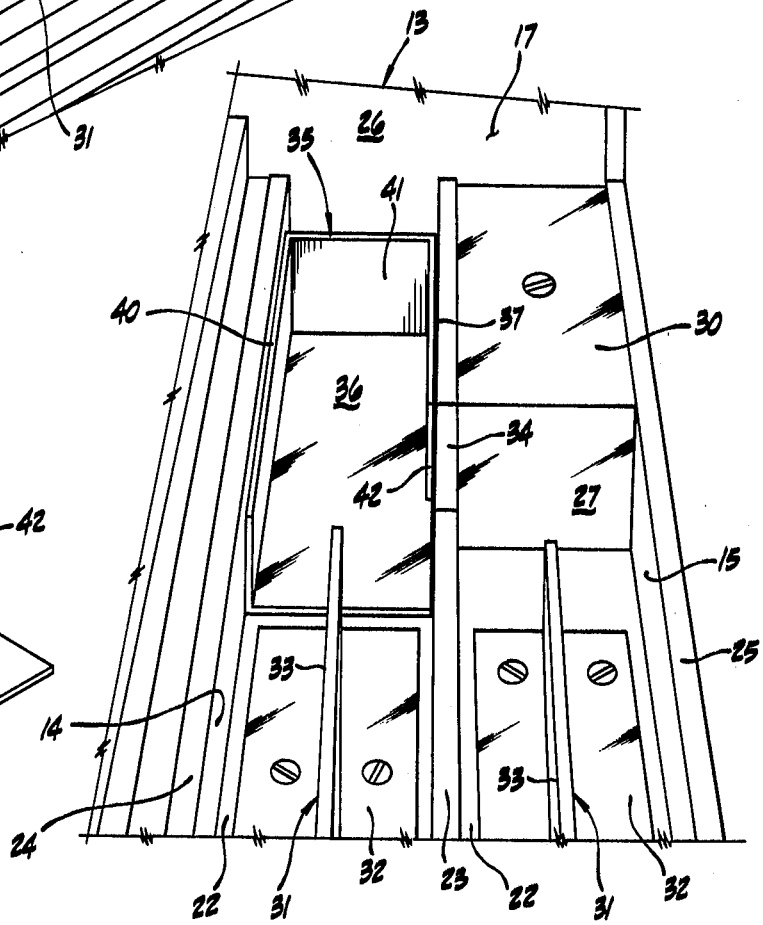
FIG. 2 is a fragmentary, enlarged perspective view showing the debris-collecting assembly at one side of the door frame.

At the other side of the door frame 13, the structure shown in FIG. 2 is relatively reversed with the pan 35 located at the end of channel 15, and with the block 30 located at the end of channel 14. Accordingly, the detailed description of the dust-collecting assembly at one side of the door frame 13 will suffice for the debris-collecting assembly at the other side of the door frame 13.

It is thought that the usage and functional advantages of the debris-collecting assembly have become fully apparent from the foregoing detailed description of parts, but for completeness of disclosure, the use will be briefly described. It will be assumed that the pan 35 is located in its compartment at the end of channel 14. As the door 20 moves on the track means 31 in the channel 14, and is slidably moved to its closed position, the door 20 will move into the pan 35 without any interference. It will be understood that the door 21 in its closed position is moved into its associated pan 35 in channel 15 at the opposite side of the door frame 13.

When it is desired to clean the door channels 14 and 15, the door 21 is maintained in its closed position, while the door 20 is slidably moved away from the side door jamb 17 toward an open position. Then, debris in the channel 14 is swept into the pan 35 through its open end while the debris in channel 15 is swept through the passage 34 and into the pan 35. When all of the debris in this portion of channels 14–15 has been collected in the pan 35 in this manner, the pan 35 can be easily removed from the channel 14, emptied and replaced. Then, the door 20 can be moved back to its closed position in which the door 20 is received in the pan 35.

It will be understood that the usage of the pan 35 at the opposite side of the door frame 13 for collecting the debris in the other portion of the channels 14–15 is substantially the same, except that the door 20 is maintained in its closed position and the door 21 is moved to its open position.

I claim as my invention:

1. A debris-collecting assembly, comprising:

(a) a door frame including an elongate lower channel, (b) a door slidably mounted in the channel for movement between open and closed positions, and (c) a top-open pan removably located in the channel, the pan being open at one end to receive debris swept along the channel when the door is in its open position, and to receive the door in its closed position.

2. A debris-collecting assembly as defined in claim 1, in which:

(d) the channel is open at the top, and (e) the pan is removable and replaceable in the channel through the open channel top.

3. A debris-collecting assembly as defined in claim 1, in which:

(d) the channel has a bottom wall and a closed end, and (e) the pan includes a bottom wall, side walls, and an end wall, the pan being located with the bottom pan wall adjacent the channel bottom wall and with the pan end wall adjacent the closed channel end.

4. A debris-collecting assembly as defined in claim 1, in which:

(d) the channel has a bottom wall, opposed side walls, and a closed end wall, the channel being open at the top, and (e) the pan includes a bottom wall adjacent the channel bottom wall, side walls adjacent the channel side walls, and an end wall adjacent the channel end wall, the pan being open at the top and at the opposite end, and the pan being removable and replaceable in the channel through the open channel top.

5. A debris-collecting assembly as defined in claim 1, in which:

(d) an elongate track means is in the channel and slidably engages the door, the track means terminating short of the open pan end.

6. A debris-collecting assembly as defined in claim 1, in which:

(d) the channel has a bottom wall and closed end, (e) an elongate track means is in the channel and slidably engages the door, the track means being spaced from the closed channel end to provide a compartment, and (f) the pan is removably located in the channel compartment with the open pan end facing toward the track means.

7. A debris-collecting assembly as defined in claim 1, in which:

(d) the door frame includes a pair of elongate lower channels disposed in side-by-side relation, (e) a pair of doors are provided, one door being slidably mounted in each channel for movement between open and closed positions, (f) passage means is provided between the channels for placing the channels in communication, and (g) the top-open pan is removably located in one channel, the open pan end being disposed to receive debris swept along said one channel and to receive debris swept along said other channel and through said passage means when the door in said one channel is in the open position and the door in the said other channel is in the closed position.

8. A debris-collecting assembly as defined in claim 7, in which:

(h) a partition is provided between the channels, and (i) the passage means is provided in the partition adjacent the open pan end.

9. A debris-collecting assembly as defined in claim 7, in which:

(h) each channel has a bottom wall and a closed end wall, and being open at the top, (i) a partition is provided between the channels, (j) the pan includes a bottom wall adjacent the bottom wall of said one channel, side walls, one of which is adjacent the partition, and an end wall adjacent the closed end wall of said one channel, the pan being open at the top and at the opposite end, and the pan being removable and replaceable in the said one channel through the open top, and (k) the passage means is in the partition adjacent the open pan end and extends substantially to the channel bottom walls.

10. A debris-collecting assembly as defined in claim 9, in which:

(l) the said one side wall of the pan is provided with an opening at the open pan end, the opening being substantially aligned with the passage means in the partition.

11. A debris-collecting assembly as defined in claim 10, in which:

(m) an elongate track means is in each channel and slidably engages the door in the channel, the track means being spaced from the closed channel ends to provide compartments therebetween, (n) the pan is removably located in the compartment of said one channel with the open pan end facing toward the track means in said one channel, and (o) the passage means in the partition is located between the compartments.

* * * * *